US010760196B2

(12) United States Patent
Inoue

(10) Patent No.: US 10,760,196 B2
(45) Date of Patent: Sep. 1, 2020

(54) LAUNDRY TREATMENT APPARATUS AND MAGNETIC GEAR DEVICE

(71) Applicant: LG Electronics Inc., Seoul (KR)

(72) Inventor: Hiroyuki Inoue, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 203 days.

(21) Appl. No.: 15/567,129

(22) PCT Filed: Apr. 18, 2016

(86) PCT No.: PCT/KR2016/004018
§ 371 (c)(1),
(2) Date: Oct. 17, 2017

(87) PCT Pub. No.: WO2016/171439
PCT Pub. Date: Oct. 27, 2016

(65) Prior Publication Data

US 2018/0163337 A1 Jun. 14, 2018

(30) Foreign Application Priority Data

Apr. 23, 2015 (KR) ..... 10-2015-0057092
Apr. 23, 2015 (KR) ..... 10-2015-0057093

(51) Int. Cl.
*D06F 37/30* (2020.01)
*D06F 37/22* (2006.01)
(Continued)

(52) U.S. Cl.
CPC ..... *D06F 37/304* (2013.01); *D06F 33/00* (2013.01); *D06F 37/04* (2013.01); *D06F 37/22* (2013.01); *D06F 37/30* (2013.01)

(58) Field of Classification Search
None
See application file for complete search history.

(56) References Cited

U.S. PATENT DOCUMENTS 5,569,111 A * 10/1996 Cho ..... H02K 49/102 310/103
2004/0245878 A1* 12/2004 Kim ..... H02K 1/18 310/114
(Continued)

FOREIGN PATENT DOCUMENTS

CN 203339913 U 12/2013
EP 2763298 A2 8/2014
(Continued)

OTHER PUBLICATIONS

Derwent DE102010030163 A1 publication, Jun. 16, 2010 (Year: 2010).*

*Primary Examiner* — Cristi J Tate-Sims
(74) *Attorney, Agent, or Firm* — Dentons US LLP

(57) ABSTRACT

Disclosed are a laundry treatment apparatus and a magnetic gear device. The laundry treatment apparatus includes a cabinet for defining an external appearance of the laundry treatment apparatus, a drum rotatably disposed inside the cabinet for accommodating laundry therein, and a power unit for rotating the drum. The power unit includes a rotational magnetic field generator fixed inside the cabinet for generating a rotational magnetic field, a magnetic flux converter provided radially outside of the rotational magnetic field generator for forming a magnetic path, and a magnetic rotator provided radially outside of the magnetic flux converter, the magnetic rotator having at least one permanent magnet inside thereof.

16 Claims, 5 Drawing Sheets

(51) Int. Cl.
*D06F 33/00* (2020.01)
*D06F 37/04* (2006.01)

(56) References Cited

U.S. PATENT DOCUMENTS

| | | | | |
|---|---|---|---|---|
| 2007/0186692 | A1 | 8/2007 | Waszak et al. | |
| 2010/0126234 | A1 | 5/2010 | Maekawa | |
| 2011/0121672 | A1* | 5/2011 | Calverley | H02K 51/00 310/103 |
| 2011/0309706 | A1* | 12/2011 | Takahashi | H02K 1/276 310/156.53 |
| 2013/0233026 | A1* | 9/2013 | Yoon | D06F 37/304 68/12.16 |
| 2014/0069151 | A1 | 3/2014 | Yoon et al. | |

FOREIGN PATENT DOCUMENTS

| | | | | |
|---|---|---|---|---|
| JP | 2000-324736 | A | 11/2000 | |
| WO | 2014/208959 | A1 | 12/2014 | |
| WO | WO-2014208959 | A1 * | 12/2014 | D06F 37/304 |

* cited by examiner

【Figure 1】
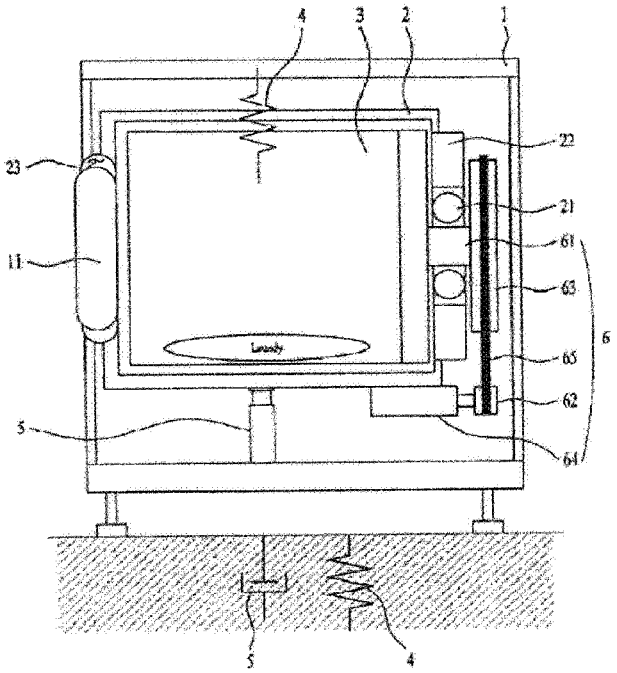
【Figure 2】
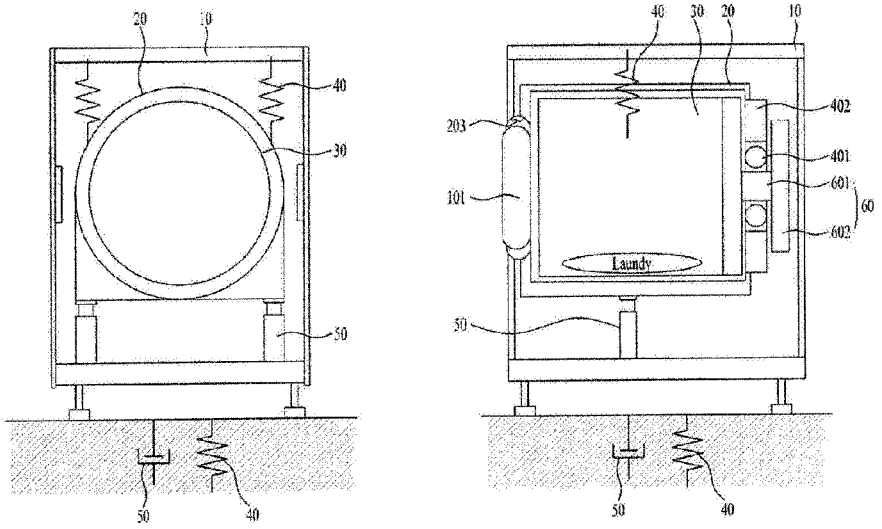

【Figure 3】
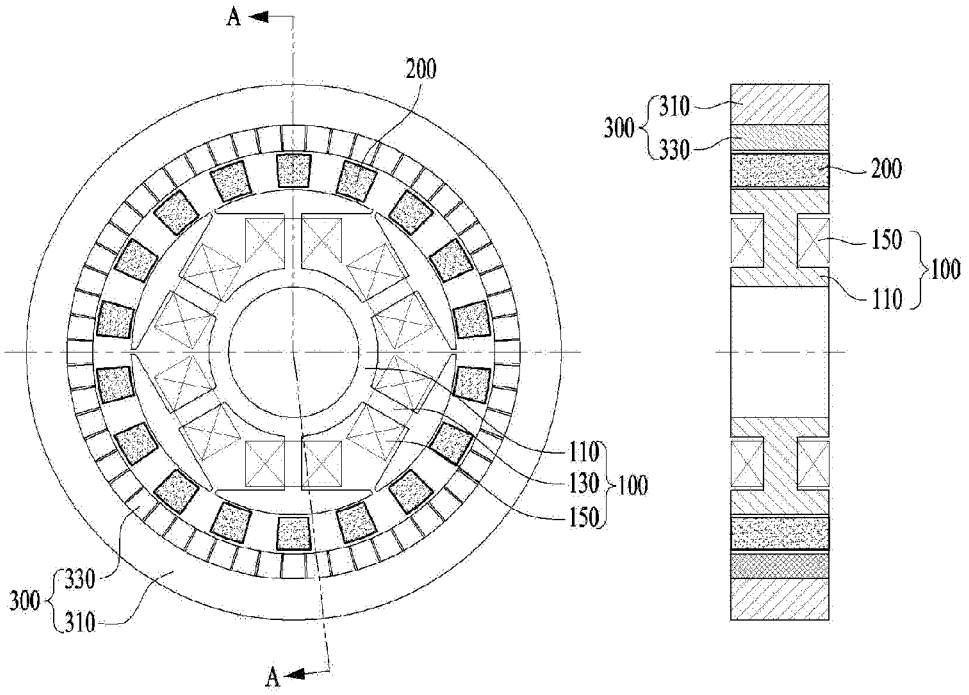
【Figure 4】
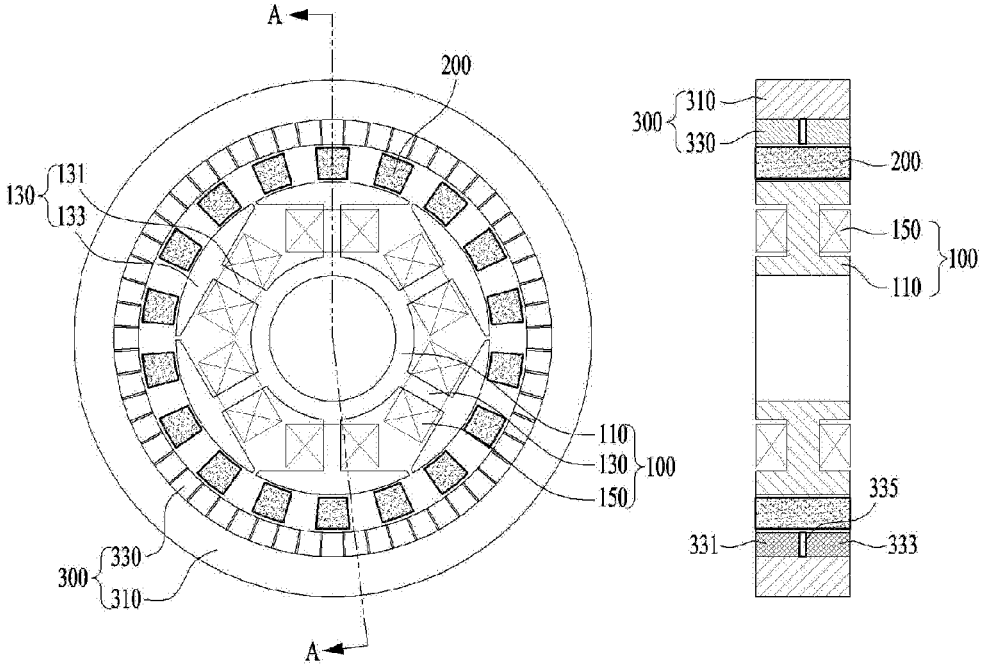

【Figure 5】
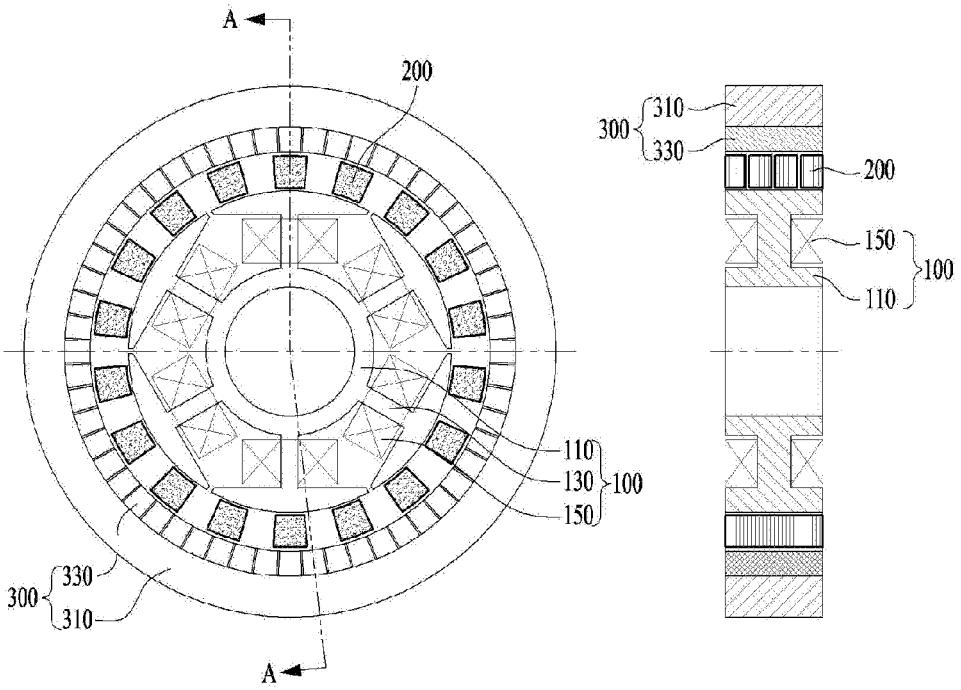
【Figure 6】
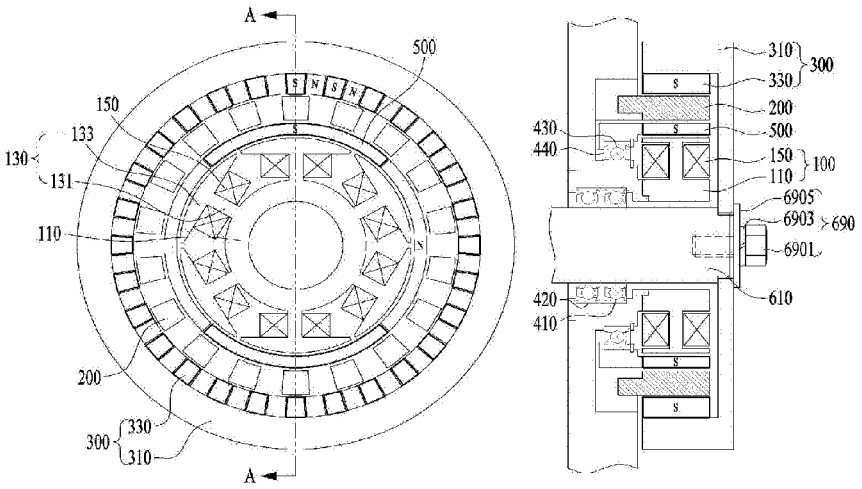

【Figure 7】
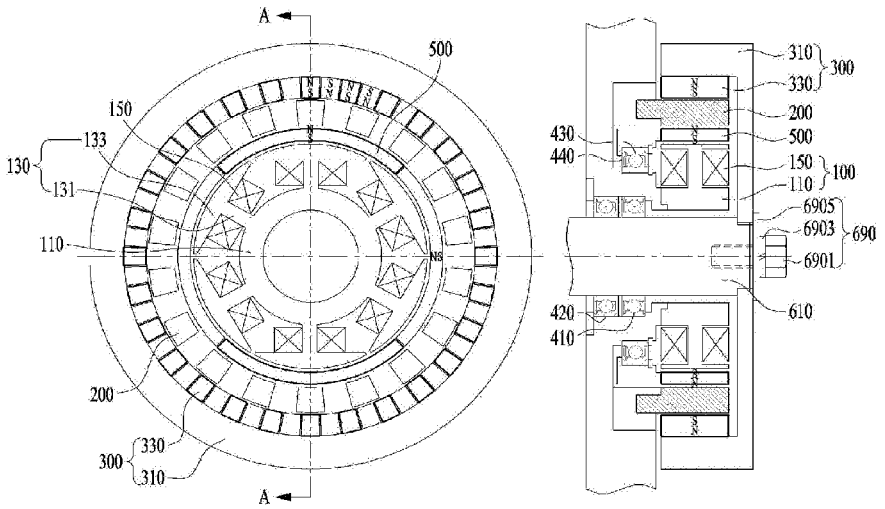
【Figure 8】
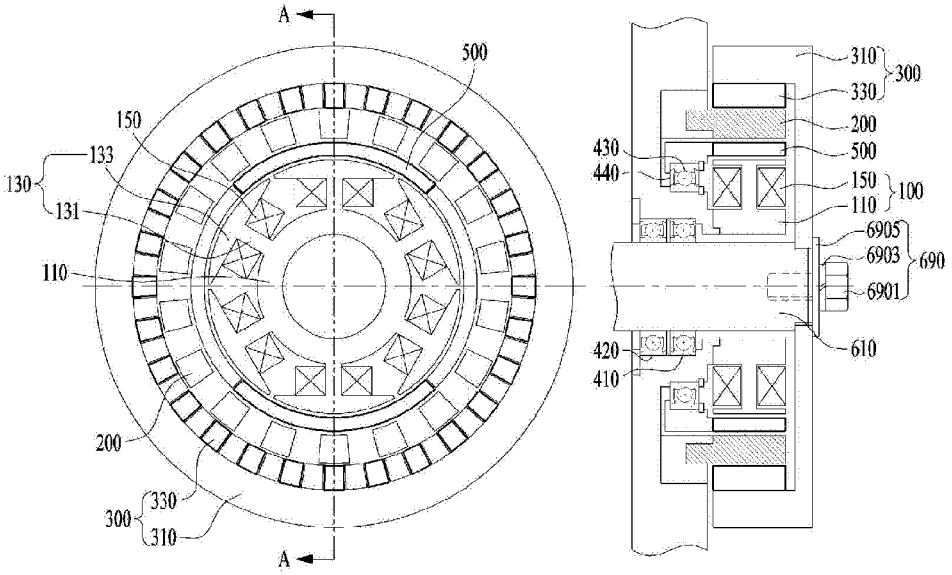

【Figure 9】
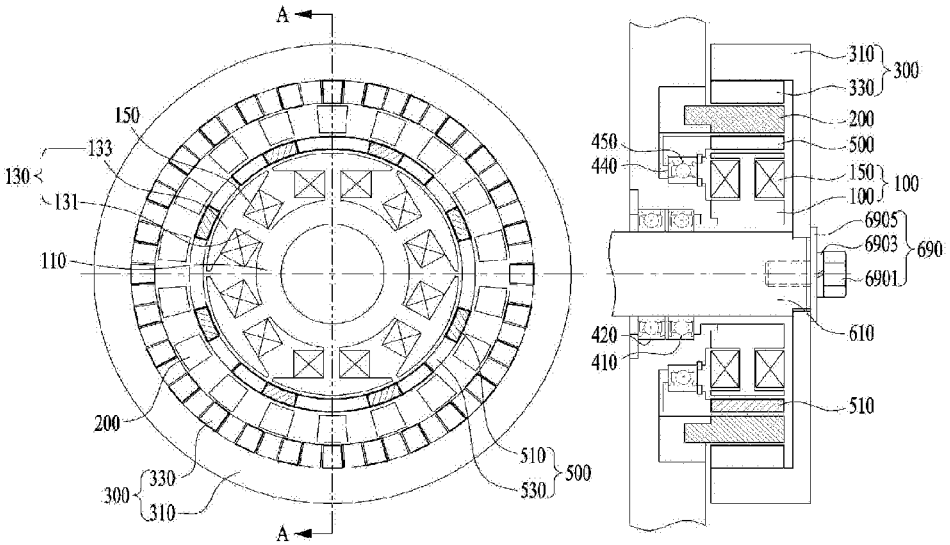
【Figure 10】
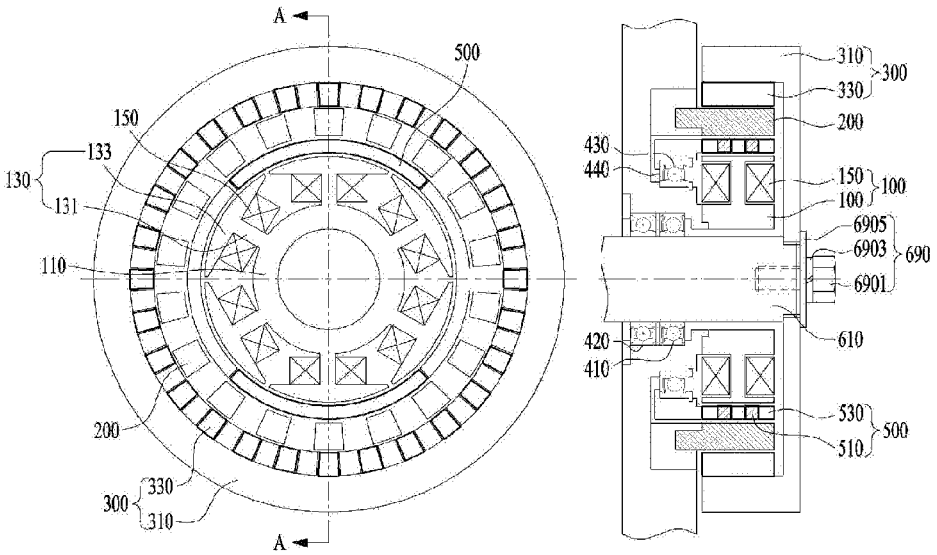

LAUNDRY TREATMENT APPARATUS AND MAGNETIC GEAR DEVICE

This application is a National Stage Entry of International Application No. PCT/KR2016/004018 filed Apr. 18, 2016, and claims the benefit of Korean Application Nos. 10-2015-0057093 filed Apr. 23, 2015, and 10-2015-0057092 filed Apr. 23, 2015, all of which are hereby incorporated by reference for all purposes as if fully set forth herein.

TECHNICAL FIELD

The present invention relates to a laundry treatment apparatus and a magnetic gear device.

BACKGROUND ART

FIG. 1 is a view illustrating a conventional belt-drive type laundry treatment apparatus.

The conventional laundry treatment apparatus illustrated in FIG. 1 may include a cabinet 1 for defining the external appearance of the laundry treatment apparatus, a tub 2 provided inside the cabinet 1 for accommodating wash water therein, and a drum 3 rotatably provided inside the tub 2 for accommodating laundry therein.

Each of the cabinet 1 and the tub 2 has an introduction/discharge opening for communication between the inside and the outside thereof. The laundry treatment apparatus further includes a door 11 for opening or closing the introduction/discharge opening.

The cabinet 1 includes a spring 4 and a damper 5 in order to reduce vibrations generated while the drum 3 is rotated.

The laundry treatment apparatus further includes a power unit 6 provided on the lower surface of the tub 2 for generating torque.

The power unit 6 includes a motor 64 for generating torque, a first pulley 62 configured to be rotatable by the torque generated by the motor 64, a second pulley 63 having a greater diameter than that of the first pulley 62, a belt 65 for connecting the first pulley 62 and the second pulley 63 to each other so as to cause the first pulley 62 and the second pulley 63 to rotate at the same time, and a shaft 61 having one end integrally formed with one surface of the second pulley 63 and the other end integrally formed with the drum 3 so as to transmit the torque generated by the power unit 6 to the drum 3.

More specifically, the torque generated by the motor 64 is transmitted to the first pulley 62, which has a smaller diameter than that of the second pulley 63. To this end, the first pulley 62 and the second pulley 63 are connected to each other via the belt 65. Through the first pulley 62 and the second pulley 63, which have different diameters from each other, low speed high torque is transmitted to the drum 3.

In order to reduce radial load generated when the shaft 61 is rotated, the tub 2 includes a bearing housing 22 and a bearing 21 rotatably provided inside the bearing housing 22.

The conventional belt-drive type speed-reduction mechanism, which implements speed reduction using a pulley, suffers from noise generated by rotation of the belt 65.

In addition, the belt 65 may be problematically cut.

In addition, assembly is difficult because the first pulley 62 and the second pulley 63 are provided inside the cabinet 1 and the space for the rotation of the belt 65 is required inside the cabinet 1.

In addition, because the first pulley 62 is rotated at a high speed and the second pulley 63 is rotated at a high torque in the state in which the belt 65 is in contact with the first pulley 62 and the second pulley 63, the efficiency of the motor 64 is deteriorated due to friction.

In addition, because the belt 65 is in contact with the first pulley 62 and the second pulley 63, when an excessive load is applied to the power unit 6, the motor 64 is at the risk of burning out.

FIG. 2 is a view illustrating a conventional direct-drive type laundry treatment apparatus.

The conventional laundry treatment apparatus illustrated in FIG. 2 may include a cabinet 10 for defining the external appearance of the laundry treatment apparatus, a tub 20 provided inside the cabinet 10 for accommodating wash water therein, and a drum 30 rotatably provided inside the tub 20 for accommodating laundry therein.

The cabinet 10 includes a spring 40 and a damper 50 in order to reduce vibrations generated while the drum 30 is rotated.

Each of the cabinet 10 and the tub 20 has an introduction/discharge opening for communication between the inside and the outside thereof. The laundry treatment apparatus includes a door 101 for opening or closing the introduction/discharge opening.

The laundry treatment apparatus further includes a power unit 60 for rotating the drum 30. The power unit 60 generates torque, and in turn the torque generated by the power unit 60 is transmitted to a shaft 601 to thereby be transmitted to the drum 30, which is integrally formed with the shaft 601 so as to be rotated along with the shaft 601.

In order to reduce radial load generated when the shaft 601 is rotated, the tub 20 includes a bearing housing 402 and a bearing 401 rotatably provided inside the bearing housing 402.

The power unit 60 includes a stator (not illustrated) for generating a rotational magnetic field, and a rotor (not illustrated) configured to be rotated by the rotational magnetic field generated by the stator (not illustrated).

The conventional direct-drive type laundry treatment apparatus illustrated in FIG. 2 further includes a gear for transmitting high torque to the drum 30.

However, because the gear transmits power while in contact with the shaft 601, the gear may generate vibration and concomitant noise due to the contact with the shaft 601.

In addition, when speed reduction is implemented in the state in which the gear is in contact with the shaft 601, deterioration in transmission efficiency occurs.

In addition, because the gear is in contact with the shaft 601, when an excessive load is applied to the power unit 60, a motor 602 is at the risk of burning out.

In addition, in a magnetic gear device in which a gear is rotated in a contactless state, when the rotor is rotated at a high speed, variation in magnetic flux occurs at a high frequency in a magnetic path forming member or a magnet unit. Due to this, eddy current is generated, thus causing the emission of heat from the magnetic path forming member or the magnet unit, which results in deterioration in transmission efficiency.

DISCLOSURE

Technical Problem

Therefore, the present invention has been made in view of the above problems, and it is an object of the present invention to provide a magnetic gear device, which may reduce vibration and concomitant noise.

In addition, it is another object of the present invention to provide a magnetic gear device, which may prevent a failure in which a belt is accidentally cut.

In addition, it is another object of the present invention to provide a magnetic gear device, which simplifies assembly thereof owing to the omission of a belt.

In addition, it is another object of the present invention to provide a magnetic gear device, which is of a contactless type, and thus improves the efficiency of a motor.

In addition, it is another object of the present invention to provide a magnetic gear device, which prevents a magnetic flux from varying at a high frequency in a magnetic path forming member or a magnet unit when an output magnetic gear unit is rotated at a high speed, thereby enhancing transmission efficiency.

In addition, it is a further object of the present invention to provide a magnetic gear device, which prevents a magnetic path forming member or a magnet unit of an output magnetic gear unit from emitting heat due to eddy current, thereby preventing deterioration in transmission efficiency.

Technical Solution

In accordance with an aspect of the present invention, the above and other objects can be accomplished by the provision of a laundry treatment apparatus including a cabinet for defining an external appearance of the laundry treatment apparatus, a drum rotatably disposed inside the cabinet for accommodating laundry therein, and a power unit for rotating the drum, wherein the power unit includes a rotational magnetic field generator fixed inside the cabinet for generating a rotational magnetic field, an input magnetic gear rotatably provided radially outside of the rotational magnetic field generator for transmitting the rotational magnetic field, a magnetic path forming unit provided radially outside of the input magnetic gear for forming a magnetic path, and an output magnetic gear unit rotatably provided radially outside of the magnetic path forming unit, the output magnetic gear unit having at least one permanent magnet inside thereof. At least a portion of the input magnetic gear may include a variable magnet, magnetic force of which is variable by a magnetic field.

In addition, the input magnetic gear may include a variable magnet unit including the variable magnet, and a stationary magnet unit including a common magnet.

In addition, the variable magnet unit and the stationary magnet unit may alternate with each other in a circumferential direction of the input magnetic gear.

In addition, the input magnetic gear may include only the variable magnet unit.

In addition, the variable magnet unit and the stationary magnet unit may alternate with each other in a thickness direction of the input magnet gear.

In addition, the variable magnet unit may include a samarium cobalt magnet.

Advantageous Effects

The present invention may provide a magnetic gear device, which may reduce vibration and concomitant noise.

In addition, the present invention may provide a magnetic gear device, which may prevent a failure in which a belt is accidentally cut.

In addition, the present invention may provide a magnetic gear device, which simplifies assembly thereof owing to the omission of a belt.

In addition, the present invention may provide a magnetic gear device, which is of a contactless type, and thus improves the efficiency of a motor.

In addition, the present invention may provide a magnetic gear device, which prevents a magnetic flux from varying at a high frequency in a magnetic path forming member or a magnet unit when an output magnetic gear unit is rotated at a high speed, thereby enhancing transmission efficiency.

In addition, the present invention may provide a magnetic gear device, which prevents a magnetic path forming member or a magnet unit of an output magnetic gear unit from emitting heat due to eddy current, thereby preventing deterioration in transmission efficiency.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view illustrating a conventional belt-drive type laundry treatment apparatus;

FIG. 2 is a view illustrating a conventional direct-drive type laundry treatment apparatus;

FIG. 3 is a view illustrating a magnetic gear device;

FIG. 4 is a view illustrating a first embodiment of a magnetic gear device in accordance with the present invention;

FIG. 5 is a view illustrating a second embodiment of a magnetic gear device in accordance with the present invention;

FIGS. 6 and 7 are views illustrating conventional magnetic gear devices;

FIG. 8 is a view illustrating a third embodiment of a magnetic gear device in accordance with the present invention;

FIG. 9 is a view illustrating a fourth embodiment of a magnetic gear device in accordance with the present invention; and FIG. 10 is a view illustrating a fifth embodiment of a magnetic gear device in accordance with the present invention.

BEST MODE

FIG. 3 is a view illustrating a magnetic gear device.

Referring to FIG. 3, the magnetic gear device may include a rotational magnetic field generator 100 for generating a rotational magnetic field, a magnetic flux converter 200 spaced apart from the outer circumferential surface of the rotational magnetic field generator 100 by a prescribed distance for changing the magnetic flux of the rotational magnetic field generated by the rotational magnetic field generator 100, and a magnetic rotator 300 rotatably spaced apart from the outer circumferential surface of the magnetic flux converter 200 by a prescribed distance, the magnetic rotator 300 being rotated by the magnetic flux changed by the magnetic flux converter 200.

In accordance with one embodiment of the present invention, a brushless direct current (BLDC) motor may include the rotational magnetic field generator 100, and the magnetic rotator 300, which is rotated by a rotational magnetic field generated by the rotational magnetic field generator 100.

A conventional BLDC motor is impossible to increase or reduce torque of the magnetic rotator 300 by increasing or reducing the RPM of the magnetic rotator 300, which is rotated by the rotational magnetic field generated by the rotational magnetic field generator 100.

However, in accordance with one embodiment of the present invention, the magnetic gear device includes the magnetic flux converter 200 between the rotational magnetic field generator 100 and the magnetic rotator 300 so as to change the magnetic flux of the rotational magnetic field transmitted from the rotational magnetic field generator 100 to the magnetic rotator 300, thereby increasing or reducing the RPM of the magnetic rotator 300, and consequently increasing or reducing the torque of the magnetic rotator 300.

The rotational magnetic field generator 100 and the magnetic flux converter 200 may be spaced apart from each other by a prescribed distance, and the magnetic flux converter 200 and the magnetic rotator 300 may be spaced apart from each other by a prescribed distance.

Due to this, the magnetic rotator 300 is driven using the rotational magnetic field from the rotational magnetic field generator 100 so as to be reduced in rotational speed thereof without contact of any speed reducer, rather than being reduced in rotational speed using a contact type speed reducer, such as a belt or a gear. In this way, the rotational speed of the magnetic rotator 300 may be increased or reduced, and consequently, torque transmitted by the magnetic rotator 300 may be increased or reduced.

The magnetic gear device, in which the rotational magnetic field generator 100, the magnetic flux converter 200, and the magnetic rotator 300 are provided so as not to come into contact with one another, may reduce noise because the magnetic rotator 300 may be used in a high-speed rotational state in which it is rotated at a high speed.

In this case, the small distances between the rotational magnetic field generator 100 and the magnetic flux converter 200 and between the magnetic flux converter 200 and the magnetic rotator 300 are more preferable.

This is because, when the distance between the rotational magnetic field generator 100 and the magnetic flux converter 200 is increased, the density of the magnetic flux, generated by the rotational magnetic field generator 100 and transmitted to the magnetic flux converter 200, is reduced, which may reduce the efficiency of the magnetic gear device.

In addition, this is because, when the distance between the magnetic flux converter 200 and the magnetic rotator 300 is increased, the density of the magnetic flux, transmitted from the magnetic flux converter 200 to the magnetic rotator 300, is reduced, which may reduce the efficiency of the magnetic gear device.

The rotational magnetic field generator 100 may include a central portion 110 having a hollow shape and a protruding portion 130 radially outwardly protruding from the central portion 110.

The protruding portion 130 may include a winding portion 131, around which a coil 150 is wound, and a flat surface portion 133, which prevents the coil 150 from being unwound from the winding portion 131 and transmits the rotational magnetic field generated by the rotational magnetic field generator 100 to the magnetic flux converter 200.

The magnetic flux converter 200 may include a plurality of magnetic substances, which are spaced apart from one another by a prescribed distance in the circumferential direction.

The magnetic substance may be an electrical steel plate or a dust core.

The magnetic rotator 300 may include a body 310, and a magnet unit 330, which includes a plurality of magnets provided on the inner circumferential surface of the body 310 and interacts with the rotational magnetic field generated by the rotational magnetic field generator 100.

Although the magnet unit 330 may be configured such that S-poles and N-poles of the magnets are alternately arranged in the circumferential direction as illustrated in the drawing, it is sufficient for the magnetic rotator 300 to be rotated by interacting with the rotational magnetic field generated by the rotational magnetic field generator 100, and the number and arrangement of the magnets provided in the magnet unit 330 may be modified, without being limited thereto.

FIG. 4 is a view illustrating a first embodiment of a magnetic gear device in accordance with the present invention.

Referring to FIG. 4, the magnetic gear device may include the rotational magnetic field generator 100 for generating a rotational magnetic field, the magnetic flux converter 200 spaced apart from the outer circumferential surface of the rotational magnetic field generator 100 by a prescribed distance for changing the magnetic flux of the rotational magnetic field generated by the rotational magnetic field generator 100, and the magnetic rotator 300 rotatably spaced apart from the outer circumferential surface of the magnetic flux converter 200 by a prescribed distance, the magnetic rotator 300 being rotated by the magnetic flux changed by the magnetic flux converter 200.

The magnetic rotator 300 may include the body 310, and the magnet unit 330, which includes a plurality of magnets provided on the inner circumferential surface of the body 310 and interacts with the rotational magnetic field generated by the rotational magnetic field generator 100.

The configuration of the rotational magnetic field generator 100 related to the generation of the rotational magnetic field is the same as that of a BLDC motor, which is used in the art of the present invention, and therefore a detailed description thereof is omitted herein.

As described above, when the magnetic rotator 300 is rotated at a high speed, variation in magnetic flux occurs at a high frequency in the magnetic flux converter 200 or the magnet unit 330. When the variation in magnetic flux occurs at a high frequency, eddy current is generated on the surface of the magnet unit 330 and the magnetic flux converter 200, and in turn heat is generated in the magnet unit 330 and the magnetic flux converter 200 due to the eddy current, which results in deterioration in power transmission efficiency.

In order to increase the power transmission efficiency, the first embodiment of the magnetic gear device in accordance with the present invention may include a configuration for restricting the generation of eddy current in the magnet unit 330.

To this end, the magnet unit 330 may include a first magnet unit 331 and a second magnet unit 333, which are stacked one above another in the thickness direction of the magnet unit 330.

An insulator 335 may be provided between the first magnet unit 331 and the second magnet unit 333. Alternatively, an air gap (not illustrated) may be provided between the first magnet unit 331 and the second magnet unit 333 so as to realize insulation therebetween. The following Equation relates to eddy current loss.

$$P_e = k_e \frac{(tfB_m)^2}{\rho}$$

where, $P_e$ is eddy current loss, t is the thickness of magnets, f is frequency, $B_m$ is the maximum magnetic flux density, ρ is the resistivity of the magnetic substance, and $k_e$ is a proportionality constant As compared to the case where the magnet unit 330 includes a single magnet layer, as illustrated in FIG. 4, when the magnet unit 330 includes the first magnet unit 331 and the second magnet unit 333, which are stacked one above another in the thickness direction, and the insulator 335 is provided between the first magnet unit 331 and the second magnet unit 333 so as to insulate the first magnet unit 331 and the second magnet unit 333 from each other, the thickness of magnets corresponding to "t" is halved.

Referring to the above Equation related to eddy current loss, when the thickness of magnets corresponding to "t" is halved, the eddy current loss Pe is reduced to a quarter of its former value.

Although FIG. 4 illustrates the magnet unit 330 as including the first magnet unit 331 and the second magnet unit 333, the magnet unit 330 is not limited thereto, and may be configured as forming two or more layers in the thickness direction as needed.

For example, the magnet unit 330 may be configured to form three layers. In this case, referring to the above Equation related to eddy current loss, the thickness of magnets corresponding to "t" is reduced to a third of its original value, and the eddy current loss "Pe" is reduced to a ninth of its original value.

FIG. 5 is a view illustrating a second embodiment of a magnetic gear device in accordance with the present invention.

The second embodiment includes the same basic components as those of FIG. 3 except the structure of the magnetic flux converter 200. The second embodiment has a feature such that the structure of the magnetic flux converter 200 is modified so as to restrict the generation of eddy current in the magnetic flux converter 200.

To this end, the magnetic flux converter 200 may include a plurality of magnetic substances stacked one above another in the thickness direction.

The following Equation relates to eddy current loss.

$$P_e = k_e \frac{(tfB_m)^2}{\rho}$$

where, $P_e$ is eddy current loss, t is the thickness of the magnet flux converter, f is frequency, $B_m$ is the maximum magnetic flux density, ρ is the resistivity of the magnetic substance, and $k_e$ is a proportionality constant For example, when the magnetic flux converter 200 includes magnetic substances stacked one above another to form two layers, the thickness t of the magnetic flux converter 200 is halved compared to the case where the magnetic flux converter 200 includes a single magnetic substance layer.

Referring to the above Equation, the resulting eddy current loss is reduced to a quarter of its original value.

That is, the magnetic substances, which are stacked one above another to construct the magnetic flux converter 200, must be separate magnetic substances, and to this end, the respective stacked magnetic substances may be insulated from one another. An insulator may be provided between the respective magnetic substances, or the space between the respective magnetic substances may remain empty.

Although the present embodiment has described the case where the magnetic flux converter 200 includes magnetic substances stacked one above another in two layers by way of example, the number of magnetic substances stacked in the magnetic flux converter 200 may be changed as needed, without being limited thereto.

FIGS. 6 and 7 are views illustrating conventional magnetic gear devices.

Referring to FIGS. 6 and 7, each of the conventional magnetic gear devices may be provided in a support unit. The support unit (not illustrated) may include a shaft hole (not illustrated) for penetration of a shaft 610, which rotates a target rotating object, a first bearing 410 for enduring a radial load when the shaft 610 penetrating the shaft hole (not illustrated) is rotated, a first bearing housing 420 in which the first bearing 410 is seated, the magnetic rotator 300 provided in a power unit so as to be rotatable along with the power unit, an input magnetic gear 500 for generating a magnetic field or transmitting a rotational magnetic field, a second bearing 430 for enduring a radial load when the input magnet gear 500 is rotated, and a second bearing housing 440 in which the second bearing 430 is seated.

That is, the conventional magnetic gear device may further include the second bearing 430 and the second bearing housing 440 because the magnetic rotator 300 and the input magnetic gear 500 are rotatable separately from the shaft 610.

Referring to FIG. 7, the conventional magnetic gear device may include the shaft 610, which is rotatably provided so as to rotate a target rotating object (not illustrated), the magnetic rotator 300, which is rotatably integrally formed with the shaft 610 so as to rotate the shaft 610, the magnetic flux converter 200, which is provided inside the magnetic rotator 300 so as to form a magnetic path or to change the magnetic flux of a rotational magnetic field, the input magnetic gear 500, which is rotatably provided inside the magnetic flux converter 200, and the rotational magnetic field generator 100, which generates a rotational magnetic field and transmits the rotational magnetic field to the input magnetic gear 500.

The magnetic rotator 300 may include the body 310, and the magnet unit 330, which is provided inside the body 310 and includes at least one permanent magnet.

The rotational magnetic field generator 100 may include the central portion 110, the protruding portion 130 radially protruding from the central portion 110, and the coil 150 wound around the protruding portion 130.

The protruding portion 130 may include the winding portion 131 radially protruding from the central portion 110, and the flat surface portion 133 provided at the distal end of the winding portion 131 so as to face the magnetic rotator 300.

The magnet unit 330 of the magnetic rotator 300 may be configured such that S-poles and N-poles alternate with each other in the circumferential direction as illustrated in FIG. 6, or may be configured such that S-poles and N-poles cross each other in the radial direction about the center of the magnetic rotator 300 as illustrated in FIG. 7.

The conventional magnetic gear devices described above and a magnetic gear device in accordance with one embodiment of the present invention have the same basic configuration with a difference in that the input magnetic gear 500 includes a variable magnet unit 510 and a stationary magnet unit 530, and thus only this difference will be described below.

FIGS. 8, 9 and 10 are views illustrating different embodiments of a magnetic gear device in accordance with the present invention.

The operation principle of the magnetic gear device in accordance with the present invention will be described below in detail with reference to FIGS. 8, 9 and 10. The rotational magnetic field generator 100 is provided at the innermost position in the radial direction of the magnetic gear device.

The input magnetic gear 500 may be located radially outside of the rotational magnetic field generator 100 with an air gap therebetween so as not to come into contact with the rotational magnetic field generator 100.

The air gap may be as small as possible in order to ensure that the rotational magnetic field, generated by the rotational magnetic field generator 100, is efficiently transmitted to the input magnetic gear 500.

The surface of the input magnetic gear 500, which faces the rotational magnetic field generator 100, may be comprised of a plurality of magnets as illustrated in FIG. 8. The input magnetic gear 500 may be rotated by the rotational magnetic field generated by the rotational magnetic field generator 100.

The input magnetic gear 500 may be provided on the radial outer circumferential surface thereof with permanent magnets at positions corresponding to gear teeth. The permanent magnets may be arranged such that N-poles and S-poles thereof alternate with each other along the radial outer circumferential surface of the input magnet gear 500. To this end, one permanent magnet is oriented such that the N-pole thereof faces outward and an adjacent permanent magnet is oriented such that the S-pole thereof faces outward.

In addition, because the magnetic rotator 300, which is located on the radial outer circumferential surface of the input magnetic gear 500, i.e. which is located radially outside of the input magnetic gear 500, is provided so as to be alternately affected by the N-pole and the S-pole, instead of arranging the permanent magnets of the input magnetic gear 500 such that the N-poles and the S-poles thereof oriented to face radially outward alternate with each other, the N-poles of the respective neighboring permanent magnets may be arranged in succession with a space therebetween.

This may reduce the number of the magnets used by half because the magnetic field of the S-pole exists near the permanent magnet having the N-pole oriented to face radially outward, based on the distribution of a magnetic field.

The input magnetic gear 500 of the magnetic gear device in accordance with the present invention may include the variable magnet unit 510, which includes variable magnetic flux magnets, the magnetic flux of which is variable such that magnetic force is reduced when a magnetic field is generated in the direction opposite to the direction of the magnetic flux, and is increased when a magnetic field is generated in the same direction as the direction of the magnetic flux, and the stationary magnet unit 530, which includes common magnets.

The variable magnetic flux magnets included in the variable magnet unit 510 may be samarium cobalt magnets, and the stationary magnet unit 530 may include neodymium magnets or ferrite magnets.

As illustrated in FIG. 8 illustrating a third embodiment of the magnetic gear device in accordance with the present invention, the input magnetic gear 500 may include only the variable magnet unit 510.

In addition, as illustrated in FIG. 9 illustrating a fourth embodiment of the magnetic gear device in accordance with the present invention, the input magnetic gear 500 may be configured such that the variable magnet unit 510 and the stationary magnet unit 530 alternate with each other in the circumferential direction of the input magnetic gear 500.

In addition, referring to FIG. 10 illustrating a fifth embodiment of the magnetic gear device in accordance with the present invention, the input magnetic gear 500 may be configured such that the variable magnet unit 510 and the stationary magnet unit 530 alternate with each other in the direction of the rotation axis about which the shaft 610 rotates.

As in the third to fifth embodiments of the magnetic gear device in accordance with the present invention described above, the variable magnet unit 510 having a variable magnetic flux may constitute at least a portion of the input magnetic gear 500.

Explaining the control of the magnetic gear device in brief with relation to the above description, the magnetic gear device generally used in the laundry treatment apparatus needs to perform a low-speed high-torque operation, in which it is required to transmit high torque while rotating a target object at a low speed, and a high-speed low-torque operation, in which it is acceptable to transmit low torque while rotating a target object at a high speed.

In the low-speed high-torque operation, the laundry treatment apparatus of the present invention performs the transmission of torque with strong magnetic flux by magnetizing the input magnetic gear. When high-speed rotation is performed in this state, large eddy current is generated, causing deterioration in power transmission efficiency.

However, in the magnetic gear device of the present invention, because the variable magnet unit 510 constitutes at least a portion of the input magnetic gear 500, the transmission of torque may be performed with low magnetic flux as the variable magnet unit 510 is demagnetized by controlling current applied to the coil 150, which is wound around the protruding portion 130 of the rotational magnetic field generator 100

The input magnetic gear 500 may transmit power to the magnetic rotator 300, which is provided radially outside of the input magnetic gear 500. The magnetic rotator 300 may include the magnet unit 330 provided on the radial inner surface thereof. As such, in order to transmit power using the magnetic gear device of the present invention, the magnet unit 330 and the stationary magnet unit 530 of the input magnetic gear 500 respectively serve as gear teeth, rather than using a conventional contact type gear.

The magnet unit 330 may be formed of a highly permeable material. When the body 310 and the magnet unit 330 are provided so as to come into surface contact with each other, the magnetic force is increased with decreasing distance to the surface of at least one permanent magnet provided in the magnet unit 330, and is reduced in the outward radial direction of the magnetic rotator 300, which is located at the opposite side of the permanent magnet and is formed of a highly permeable material.

The body 310 may be formed of a highly permeable material, such as SUS430, SS400, or soft iron.

That is, a reduction gear ratio is determined by the ratio of the number of poles of permanent magnets provided in the magnet unit 330 of the magnetic rotator 300 to that in the stationary magnet unit 530 of the input magnetic gear 500. The reduction gear ratio and the transmission of torque are clear to those skilled in the art, and thus will not be described in detail herein.

The magnetic flux converter 200 may be additionally provided between the input magnetic gear 500 and the magnet unit 330.

Because the input magnetic gear 500 and the magnetic rotator 300 are rotated along with each other, the input magnetic gear 500 may transmit a rotational magnetic field to the magnet unit 330 at a constant reduction gear ratio while rotating.

Although the magnetic flux converter 200 is rotatably provided, the magnetic flux converter 200 may be stationary in the configuration in which the magnetic rotator 300 needs to rotate as in the present invention.

The magnetic flux converter 200 may form a magnetic path, through which the rotational magnetic field generated by the rotating input magnetic gear 500 is transmitted to the magnet unit 330.

The magnetic flux converter 200 serves to form the magnetic path, and therefore may be formed of a highly permeable material. In addition, the magnetic flux converter 200 may be formed of a material, which does not generate eddy current.

This is because, when the magnetic flux converter 200 is formed of a highly permeable material, through which eddy current flows, such as iron, eddy current may be generated on the surface of the permanent magnets provided in the input magnetic gear 500 and the surface of the magnetic flux converter 200 while the input magnetic gear 500 is rotated, which causes rotational energy to be lost as thermal energy.

Accordingly, the magnetic flux converter 200 may be a stack structure in which silicon steel plates are stacked one above another, or a dust core.

The magnet unit 330 serves as a so-called output magnetic gear corresponding to the input magnetic gear 500. Therefore, in the same manner as the arrangement of the permanent magnets of the input magnetic gear 500, the magnet unit 330 may be provided such that N-poles and S-poles are alternately arranged and are oriented radially inwardly.

In addition, in order to increase productivity by reducing the use of the permanent magnets, instead of arranging the permanent magnets of the magnet unit 330 such that the N-poles and the S-poles thereof oriented to face radially inward alternate with each other, the N-poles of the respective neighboring permanent magnets may be arranged in succession with a space therebetween.

The number of magnetic poles of the magnet unit 330 and the input magnetic gear 500 are not limited to the number illustrated in the drawings, and may be changed in order to realize a required reduction gear ratio.

The magnet unit 330, the magnetic flux converter 200, and the input magnetic gear 500 may be arranged with air gaps therebetween, rather than coming into contact with one another at facing surfaces thereof.

Because magnetic force is more effectively used as the air gap is reduced, the air gap may be as small as possible.

More specifically, the air gap may be within a range from 0.1 mm to 0.5 mm.

The above detailed description is provided to exemplify the present invention. In addition, the above description is given to illustrate and explain the exemplary embodiments of the present invention, but the present invention may be used in various other combinations, modifications, and environments. That is, the present invention may be changed or modified within the scope of the concept of the present invention disclosed in this specification, the disclosure described above and equivalents thereof, and/or the technical range or the knowledge of the art. The embodiments described herein merely explain the best mode to implement the technical idea of the present invention, and various alterations thereof required by the concrete application fields and purposes of the present invention are possible. Accordingly, the above detailed description of the present invention is not intended to limit the present invention to the disclosed embodiments. In addition, the accompanying claims should be construed as including other embodiments.

MODE FOR INVENTION

As described above, a related description has sufficiently been discussed in the above "Best Mode" for implementation of the present invention.

INDUSTRIAL APPLICABILITY

As described above, the present invention may be wholly or partially applied to a magnetic gear device and a laundry treatment apparatus.

The invention claimed is:

1. A laundry treatment apparatus, comprising:

a cabinet defining an appearance of the laundry treatment apparatus;

a tub provided inside the cabinet for accommodating wash water therein;

a drum rotatably disposed inside the tub; and a power unit for rotating the drum, wherein the power unit includes:

a rotational magnetic field generator, fixed inside to the tub in which a coil is wound, to generate a rotational magnetic field;

a magnetic rotator, spaced apart from an outer circumferential surface of the rotational magnetic field generator, the magnetic rotator including at least one permanent magnet;

a magnetic flux converter, provided between radially outside of the rotational magnetic field generator and radially inside of the magnetic rotator, for changing the magnetic flux of the rotational magnetic field transmitted from the rotational magnetic field generator to the magnetic rotator; and an input magnetic gear provided radially outside of the rotational magnetic field generator to transmit the rotational magnetic field and provided to be rotatable around the same rotation axis as a rotation axis of the magnetic rotator.

2. The laundry treatment apparatus of claim 1, wherein the permanent magnet is divided into a plurality of permanent magnets in a direction parallel to a rotation axis of the drum.

3. The laundry treatment apparatus of claim 1, wherein the magnetic flux converter is divided into a plurality of magnetic flux converters in a direction parallel to a rotation axis of the drum.

4. The laundry treatment apparatus of claim 2, wherein the permanent magnet includes:

a first magnet unit provided in an upper portion;

a second magnet unit provided below the first magnet unit; and an insulator provided between the first magnet unit and the second magnet unit.

5. The laundry treatment apparatus of claim 2, wherein the permanent magnet includes:

a first magnet unit provided in an upper portion;

a second magnet unit provided below the first magnet unit; and an air gap provided between the first magnet unit and the second magnet unit to insulate the first magnet unit and the second magnet unit from each other.

6. The laundry treatment apparatus of claim 5, wherein the magnetic flux converter includes a plurality of magnetic flux converters stacked one above another in a thickness direction.

7. The laundry treatment apparatus of claim 6, wherein the magnetic flux converters are insulated from each other.

8. The laundry treatment apparatus of claim 1, wherein at least a portion of the input magnetic gear includes a variable magnet.

9. The laundry treatment apparatus of claim 8, wherein the input magnetic gear includes:

a variable magnet unit including the variable magnet; and a stationary magnet unit including a common magnet.

10. The laundry treatment apparatus of claim 9, wherein the variable magnet unit and the stationary magnet unit alternate with each other in a circumferential direction of the input magnetic gear.

11. The laundry treatment apparatus of claim 8, wherein the input magnetic gear includes only the variable magnet.

12. The laundry treatment apparatus of claim 9, wherein the variable magnet unit and the stationary magnet unit alternate with each other in a direction parallel to a rotation axis of the drum.

13. The laundry treatment apparatus of claim 8, wherein the variable magnet includes a samarium cobalt magnet.

14. The laundry treatment apparatus of claim 4, wherein the magnetic flux converter includes a plurality of magnetic flux converters stacked one above another in a thickness direction.

15. The laundry treatment apparatus of claim 14, wherein the plurality of magnetic flux converters are insulated from each other.

16. The laundry treatment apparatus of claim 8, wherein the variable magnet has a magnetic force which is variable by a magnetic field.

* * * * *